United States Patent [19]

Ishikawa et al.

[11] Patent Number: 4,513,723

[45] Date of Patent: Apr. 30, 1985

[54] FUEL SUPPLY CONTROL METHOD FOR INTERNAL COMBUSTION ENGINES AT ACCELERATION

[75] Inventors: Yoshikazu Ishikawa, Saitama; Makoto Hashiguchi, Kawagoe, both of Japan

[73] Assignee: Honda Giken Kogyo Kabushiki Kaisha, Tokyo, Japan

[21] Appl. No.: 623,846

[22] Filed: Jun. 22, 1984

[30] Foreign Application Priority Data

Jun. 22, 1983 [JP] Japan ..... 58-112298

[51] Int. Cl.[3] ..... F02D 5/02

[52] U.S. Cl. ..... 123/492; 123/480; 123/486; 123/478

[58] Field of Search ..... 123/492, 480, 486, 478, 123/440, 493; 364/431

[56] References Cited

U.S. PATENT DOCUMENTS

| | | | |
|---|---|---|---|
| 4,126,610 | 11/1978 | Harada et al. | 123/492 |
| 4,296,722 | 10/1981 | Furubashi et al. | 123/492 |
| 4,401,087 | 8/1983 | Ikura | 123/492 |
| 4,457,282 | 7/1984 | Muramatsu et al. | 123/492 |
| 4,469,074 | 9/1984 | Takao et al. | 123/492 |

*Primary Examiner*—Raymond A. Nelli
*Attorney, Agent, or Firm*—Arthur L. Lessler

[57] ABSTRACT

A fuel supply control method for an internal combustion engine, which supplies fuel to the engine in quantities appropriate to operating conditions thereof in synchronism with generation of pulses of a predetermined control signal. A plurality of groups of predetermined correction values for increasing the quantity of fuel to be supplied to the engine at acceleration thereof are set beforehand, which are functions of at least two operating parameters of the engine. When the engine is determined to be operating in a predetermined accelerating condition for the first time, values of the above at least two operating parameters are detected upon the same determination being obtained. One of the groups of predetermined correction values is selected, which corresponds to the detected values of the at least two operating parameters. Then, different ones of the predetermined correction values of the selected one group are successively applied for correction of the quantity of fuel being supplied to the engine, with passage of time after the above determination is obtained for the first time and as long as the engine is determined to be operating in the predetermined accelerating condition.

15 Claims, 8 Drawing Figures

| FIG. 4A | FIG. 4B |
|---|---|

FUEL SUPPLY CONTROL METHOD FOR INTERNAL COMBUSTION ENGINES AT ACCELERATION

BACKGROUND OF THE INVENTION

This invention relates to a method of controlling the fuel supply to an internal combustion engine at acceleration, and more particularly to a method of this kind which is intended to improve the accelerability of the engine without spoiling the driveability at the beginning of acceleration of the engine.

A fuel supply control method for internal combustion engines is already known which is adapted to first determine a basic value of the valve opening period of a fuel injection device provided in the engine, i.e. the fuel injection quantity, as a function of engine rotational speed and intake pipe absolute pressure in synchronism with generation of pulses of a predetermined crank angle position signal, e.g. a top-dead-center (TDC) signal, and then correct the basic value thus determined by adding to and/or multiplying same by constants and/or coefficients being functions of parameters indicative of operating conditions of the engine such as engine rotational speed, intake pipe absolute pressure, engine coolant temperature, throttle valve opening, exhaust gas ingredient concentration (oxygen concentration), etc., to thereby control the air/fuel ratio of a mixture being supplied to the engine.

It is a general tendency with internal combustion engines that even when the fuel supply quantity is increased and accordingly the mixture is enriched in order to accelerate the engine, the rotational speed of the engine does not increase immediately upon the increase of the fuel supply quantity due to a time lag between the start of supply of such increased fuel quantity to the engine and actual increase of the engine output torque and accordingly actual increase of engine rotational speed. Such time lag is attributable not only to a time lag between the start of supply of the increased fuel quantity and explosive combustion of the mixture within the engine cylinders, but also to a detection lag of sensors for sensing the operating conditions of the engine, a time lag between opening action of the throttle valve and actual increase of the charging efficiency of the engine and accordingly actual increase of the intake air quantity, etc. Particularly, in an internal combustion engine equipped with an electronically controlled fuel injection device, a large volume space is usually provided in the intake passage at a location downstream of the throttle valve for restraining fluctuations in the intake passage pressure to thereby minimize fluctuations in the intake air quantity. As compared with internal combustion engines equipped with carburetors, the above time lag between the supply of an accelerating increased fuel quantity to the engine and actual increase of the engine speed is conspicuous in such electronically controlled engine due to a longer period of time between opening action of the throttle valve and actual increase of the charging efficiency of the engine.

In order to compensate for a detection lag of the actual intake air quantity supplied to the engine at acceleration, it has conventionally been employed, for instance, to detect the opening speed of the throttle valve, set a value of a correction variable for increase of the fuel quantity on the basis of the detected opening speed, and supply a quantity of fuel increased by the set value of the correction variable. However, according to such accelerating fuel quantity control method, at the beginning of acceleration of the engine, that is, during a period of time after initial detection of acceleration of the engine and before several pulses of the aforementioned TDC signal are generated, the engine cannot have an increase in the output torque to a level required for the acceleration since there does not occur a sufficient increase in the charging efficiency before the lapse of the above period of time for the aforementioned reason. However, immediately when the charging efficiency and accordingly the actual intake air quantity has increased to such required level, the engine can undergo a sudden increase in the output torque. This sudden increase in the output torque causes rotational displacement of the engine body about its crankshaft. That is, while the engine body is generally mounted on a mount provided in a vehicle body, etc. via an elastic shock absorber formed e.g. of rubber, the torque increase causes an impact upon the engine body to an extent beyond the limit of absorption of impact or shock by the shock absorber. This gives an unpleasant feeling of shock to the driver, etc.

Further, when the engine is accelerated from a decelerating state wherein the position of the engine body on the mount is usually biased toward the decelerating side with respect to its neutral position, the resulting amount of displacement of the engine body is large as compared with that obtained when the engine is accelerated from a cruising state, resulting in a large shock being given to the driver, etc. In addition, the presence of backlash of parts of the driving system of the vehicle such as the transmission gear forms a further factor for increasing the accelerating shock.

SUMMARY OF THE INVENTION

It is the object of the invention to provide a fuel supply control method for internal combustion engines, which is capable of reducing the time lag between detection of an accelerating condition of the engine and occurrence of an increase in the output torque to a level effective for acceleration of the engine to thereby enhance the accelerability of the engine, and also capable of mitigating a shock upon acceleration of the engine.

The present invention provides a fuel supply control method for an internal combustion engine, which controls the quantity of fuel being supplied to the engine to values appropriate to operating conditions thereof in synchronism with generation of pulses of a predetermined control signal.

The method according to the invention is characterized by comprising the following steps:

(a) setting beforehand a plurality of groups of predetermined correction values for increasing the quantity of fuel to be supplied to the engine at acceleration thereof, which are functions of at least two operating parameters of the engine;

(b) determining whether or not the engine is operating in a predetermined accelerating condition;

(c) when it is determined for the first time that the engine is operating in the predetermined accelerating condition, detecting values of the above at least two operating parameters upon the same determination being obtained;

(d) selecting one of the groups of predetermined correction values which corresponds to the detected values of the at least two operating parameters; and (e) successively applying different ones of the predetermined correction values of the selected one group for correction of the quantity of fuel being supplied to the engine, with passage of time after the above determination that the engine is operating in the predetermined accelerating condition is obtained for the first time and as long as the engine is determined to be operating in the predetermined accelerating condition.

The above and other objects, features, and advantages of the invention will be more apparent from the ensuing detailed description taken in conjunction with the accompanying drawings.

DETAILED DESCRIPTION

Figure 1:
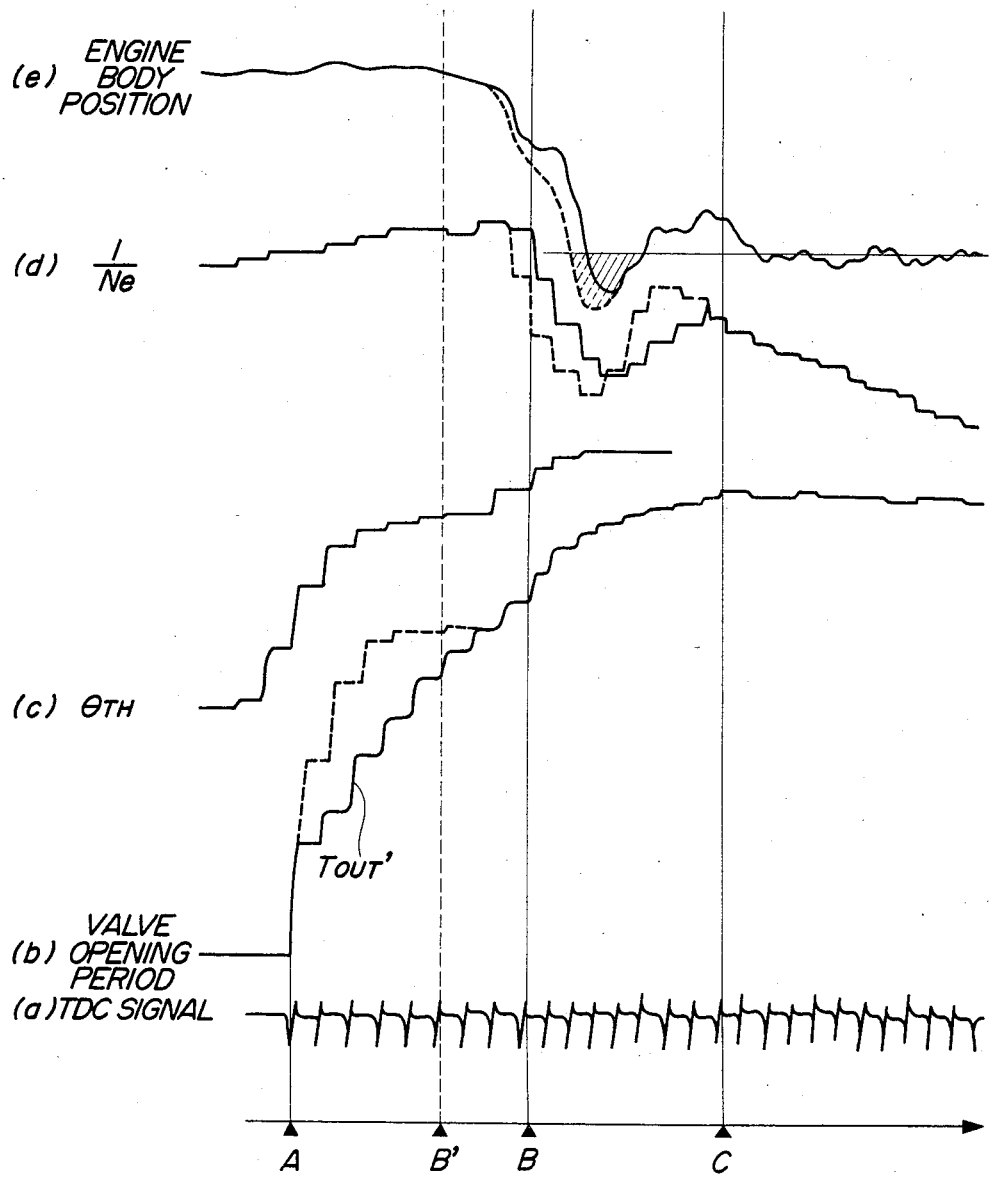
FIG. 1 (PRIOR ART)
FIG. 1 is a timing chart showing changes in the engine rotational speed Ne, displacement of the engine body on its mount, etc. with the lapse of time at acceleration of the engine according to a conventional fuel supply control method.

Referring first to FIG. 1, there are shown operating characteristics, etc. of an internal combustion engine obtained if a conventional fuel supply control method is applied at acceleration of the engine. When an accelerating condition of the engine is detected, a correction variable TACC, which is applied for increasing the fuel supply quantity at acceleration of the engine, is set to a value corresponding to the opening speed or rate of change $\Delta\theta$ of the valve opening of the throttle valve, and the value of correction variable TACC thus set is added to a valve opening period value TOUT' which is set as a function of engine operating parameters such as intake pipe absolute pressure and engine rotational speed Ne, to thereby enrich a mixture supplied to the engine at acceleration of the engine. The solid line in (b) of FIG. 1 represents changes in the valve opening period value TOUT' set as above, while the broken line in (b) of FIG. 1 represents the sum of the same value TOUT' and a set value of the correction variable TACC.

According to this fuel supply control method, if at acceleration the engine is supplied with fuel in accordance with changes in the valve opening period value TOUT' with no addition of the correction variable TACC as indicated by the solid line in (b) of FIG. 1, then the position of the engine body and the rotational speed Ne of the engine change as indicated by the respective solid lines in (e) and (d) of FIG. 1. To be specific, the valve opening period value TOUT' is set to values corresponding to increases in the intake pipe absolute pressure caused by opening of the throttle valve ((c) in FIG. 1). There is a time lag between the time the valve opening period value TOUT' starts to be increased upon acceleration of the engine, i.e. at the point A on the abscissa of time in FIG. 1 and the time the engine rotational speed Ne actually starts increasing or the reciprocal 1/Ne of same starts decreasing ((d) in FIG. 1), i.e. at the point B on the abscissa of time, with an increase in the engine output torque caused by the increase in the fuel supply quantity resulting from the increase of the valve opening period TOUT'. This time lag corresponds to the time period required for eight pulses of the TDC signal to be generated in the illustrated example ((a) in FIG. 1), and is mainly caused by not only the time lag between the supply of fuel to the engine and the occurrence of explosive combustion of the fuel within the engine cylinders, but also by detection lag of sensors for sensing operating conditions of the engine, as well as by the time lag between the opening action of the throttle valve and actual increase of the charging efficiency of the engine cylinders to such a level that the actual intake air quantity can assume a value required for causing an increase in the output torque effective for acceleration of the engine. Particularly, in an internal combustion engine equipped with an electronically controlled fuel injection device wherein a large space is generally provided within the intake pipe at a location downstream of the throttle valve to increase the substantial intake passage volume so as to restrain fluctuations in the intake pipe pressure and thereby reduce the resulting flutuations in the intake air quantity, the time lag between the opening action of the throttle valve and the actual increase in the charging efficiency is larger than those of other type internal combustion engines such as carburetor engines. That is, in the electronically controlled engine, the time lag corresponding to the time interval between the points A and B in FIG. 1 is larger than that in carburetor engines.

During the time period A–B in FIG. 1, the actual intake air quantity cannot be detected with accuracy due to detection lag of engine operating parameter sensors, mainly the intake pipe absolute pressure sensor, rendering it impossible to supply just a required amount of fuel to the engine during the same time period A–B and accordingly to achieve best combustion within the engine cylinders. Further, as previously stated, during this time period A–B, the charging efficiency of the engine is too low to obtain a required increase in the output torque effective for acceleration of the engine. In addition, thereafter, the engine suffers from a sudden increase in the output torque immediately when the charging efficiency increases to such a level that the actual intake air quantity assumes a value required for causing an increase in the output torque effective for acceleration of the engine, that is, immediately after the point B in FIG. 1. This sudden torque increase causes rotational displacement of the engine body on its mount about its crankshaft. This displacement of the engine body becomes conspicuous immediately after the point B on the time abscissa as shown in (e) of FIG. 1, and the engine body position becomes stabilized after the point C in FIG. 1 after which the engine rotational speed Ne smoothly increases. Such sudden change in the engine body position taking place between the points B and C brings about an impact upon a vehicle body through the engine mount, in which the engine is installed, and the magnitude of such impact corresponds to the amount of overshooting of the engine body position to the downward side (as viewed in FIG. 1) with respect to the stable engine body position assumed after the point C during engine acceleration, as indicated as the hatched portion in (e) of FIG. 1. The magnitude of the impact can usually surpass the shock aborbing capacity of a shock absorber such as rubber interposed between the engine body and its mount, creating an unpleasant feeling of shock to the driver and the passenger(s).

On the other hand, if the valve opening period value TOUT' is corrected by the use of the correction variable TACC whose value varies as a function of the rate of change $\Delta\theta$ in the throttle valve opening $\theta$th, in a manner shown by the broken line in (b) of FIG. 1, the above time lag can be reduced by a small margin, since this application of correction variable TACC more or less serves to compensate for inaccuracy of the fuel supply quantity caused by the detection lag of the intake pipe absolute pressure. However, since the correction variable TACC is merely a function of the rate of change $\Delta\theta$ of the throttle valve opening alone and is not set by taking into account the displacement of the engine body relative to the lapse of time, the application of the same correction variable to correction of the valve opening period does not substantially contribute to improvement of the engine torque curve characteristic, and to the contrary, it can even cause a further increase in the shock due to displacement of the engine body as indicated by the broken line in (e) of FIG. 1.

Figure 2:
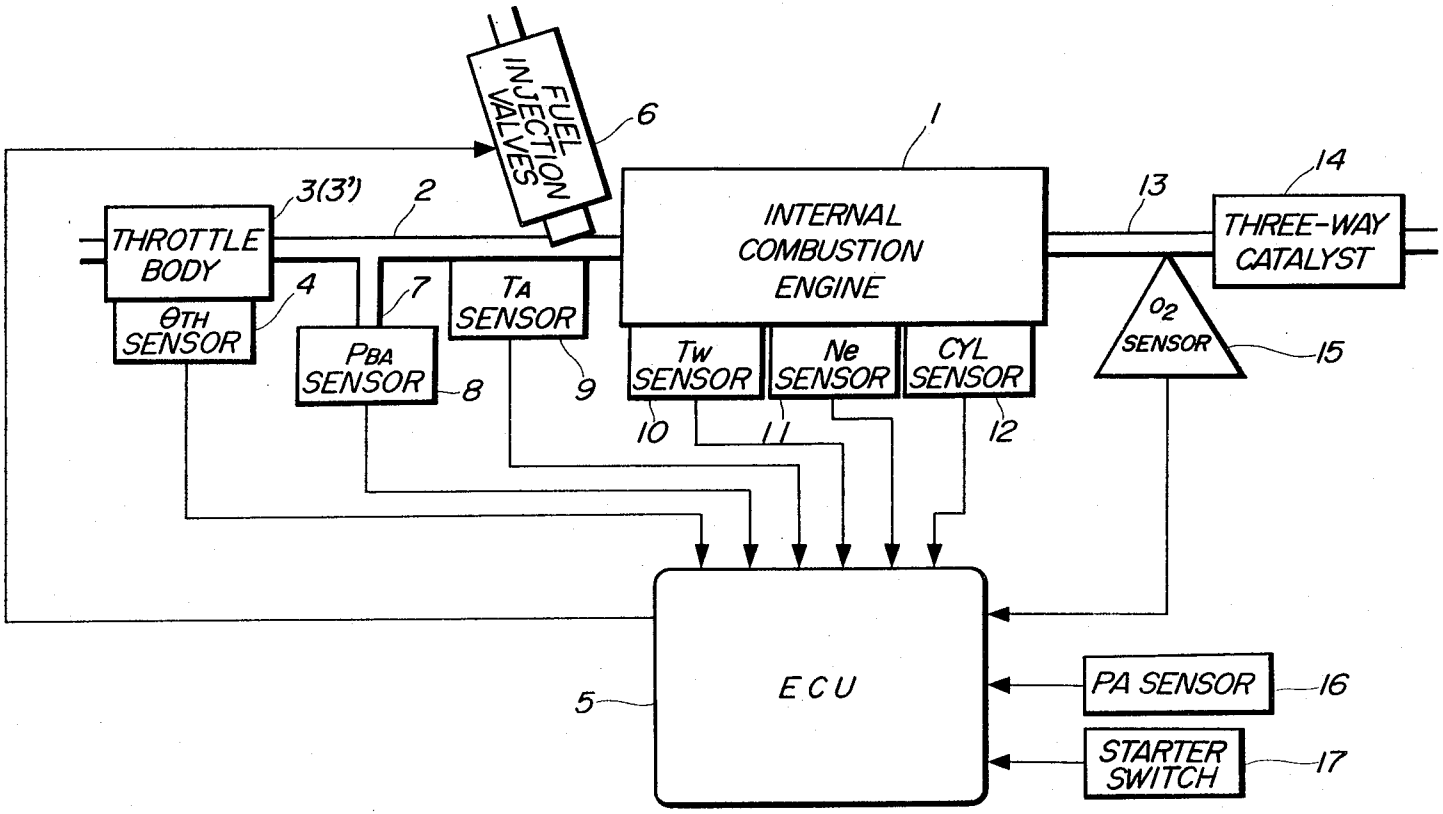
FIG. 2 is a block diagram illustrating, by way of example, the whole arrangement of a fuel injection control system to which is applied the method according to the present invention.

Referring to FIG. 2, there is illustrated the whole arrangement of a fuel injection control system for internal combustion engines, to which the method according to the invention is applied. Reference numeral 1 designates an internal combustion engine which may be a four-cylinder type for instance, and whose body is mounted on a mount of a vehicle body via an elastic shock absorber formed e.g. of rubber, not shown. An intake pipe 2 is connected to the engine 1, in which is arranged a throttle body 3 accommodating a throttle valve 3'. Connected to the throttle valve 3' is a throttle valve opening ($\theta$th) sensor 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle body 3, which correspond in number to the engine cylinders and are each arranged at a location slightly upstream of an intake valve, not shown, of a corresponding engine cylinder. These injection valves 6 are connected to a fuel pump, not shown, and also electrically connected to the ECU 5 in a manner having their valve opening periods or fuel injection quantities controlled by signals supplied from the ECU 5 as hereinafter described.

On the other hand, an absolute pressure sensor (PBA sensor) 8 communicates through a conduit 7 with the interior of the intake pipe 2 at a location immediately downstream of the throttle valve 3. The absolute pressure (PBA) sensor 8 is adapted to detect absolute pressure in the intake pipe 2 and supplies an electrical signal indicative of detected absolute pressure (PBA) to the ECU 5. An intake air temperature (TA) sensor 9 is arranged in the intake pipe 2 at a location downstream of the absolute pressure sensor 8 and also electrically connected to the ECU 5 for supplying same with an electrical signal indicative of detected intake air temperature (TA).

An engine temperature (TW) sensor 10, which may be formed of a thermistor or the like, is embedded in the cylinder block of the engine 1, an electrical output signal of which is supplied to the ECU 5.

An engine rotational angle position (Ne) sensor 11 and a cylinder-discriminating (CYL) sensor 12 are arranged in facing relation to a camshaft, not shown, of the engine 1 or a crankshaft of same, not shown. The former 11 is adapted to generate one pulse at one of particular crank angles of the engine each time the engine crankshaft rotates through 180 degrees, as a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of the detected concentration value to the ECU 5. Further connected to the ECU 5 are a sensor 16 for detecting atmospheric pressure and supplying an electrical signal indicative of detected atmospheric pressure to the ECU 5.

The ECU 5 operates in response to various engine operation parameter signals as stated above, to determine operating conditions in which the engine is operating, such as an accelerating condition, and a fuel-cut effecting condition, and to calculate the fuel injection period TOUT of the fuel injection valves 6, which is given by the following equation, in accordance with the determined operating conditions of the engine and in synchronism with generation of pulses of the TDC signal:

$$TOUT = TI \times K_1 + TACC \times K_2 \times K_3 \quad (1)$$

where Ti represents a basic value of the fuel injection period for the fuel injection valves 6, which is determined as a function of the engine rotational speed Ne and the intake pipe absolute pressure PBA, and TACC a correction variable applied when the engine is accelerating. $K_1$, $K_2$, and $K_3$ are correction variables which have their values calculated by the use of respective equations on the basis of the values of the engine operation parameter signals from the aforementioned various sensors so as to optimize the operating characteristics of the engine such as startability, emission characteristics, fuel consumption, and accelerability.

The ECU 5 operates on the value of the fuel injection period TOUT determined as above to supply corresponding driving signals to the fuel injection valves 6 to drive same.

Figure 3:
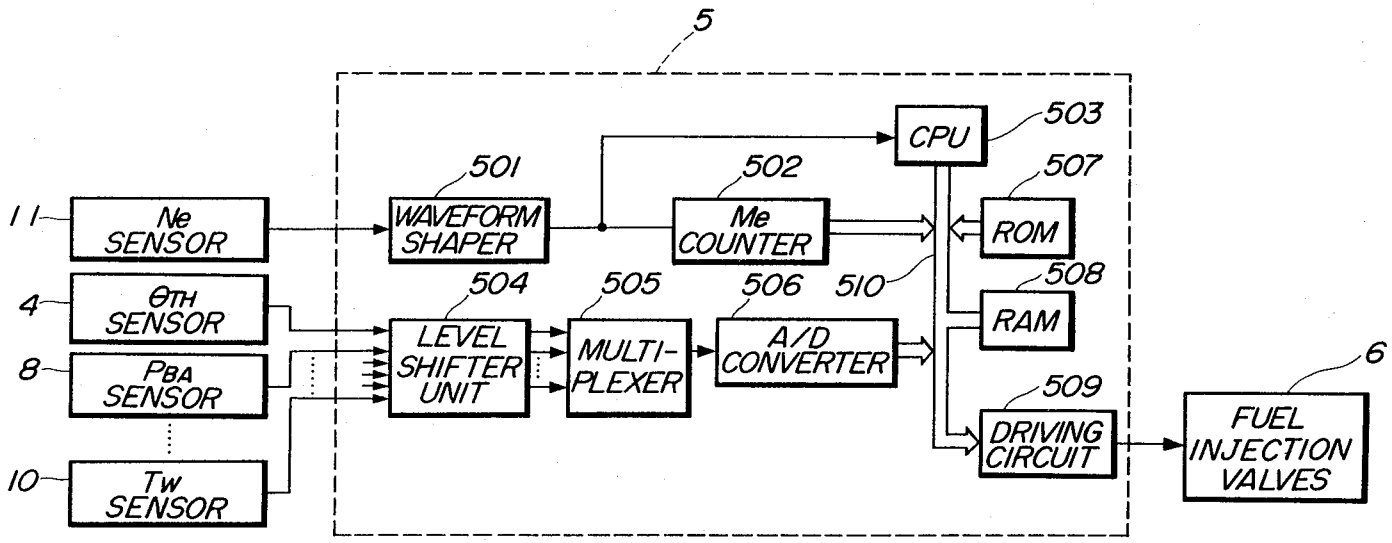
FIG. 3 is a block diagram illustrating, by way of example, the interior construction of an electronic control unit (ECU) appearing in FIG. 2.

FIG. 3 shows a circuit configuration within the ECU 5 in FIG. 2. An output signal from the engine rotational angle position (Ne) sensor 11 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal and a present pulse of the same signal, inputted thereto from the engine rotational angle position sensor 11, and therefore its counted value Me varies in proportion to the reciprocal of the actual engine rpm Ne. The Me value counter 502 supplies the counted value Me to the CPU 503 via a data bus 510.

The respective output signals from the throttle valve opening sensor 4, the intake pipe absolute pressure sensor 8, the engine cooling water temperature sensor 10, etc. appearing in FIG. 2 have their voltage levels successively shifted to a predetermined voltage level by a level shifter unit 504 and successively applied to an analog-to-digital converter 506 through a multiplexer 505.

Further connected to the CPU 503 via the data bus 510 are a read-only memory (hereinafter called "the ROM") 507, a random access memory (hereinafter called "the RAM") 508, and a driving circuit 509. The RAM 508 temporarily stores detected values of outputs from the aforementioned sensors and various calculated values from the CPU 503, while the ROM 507 stores a control program to be executed within the CPU 503 as well as a map of the basic fuel injection period Ti for the fuel injection valves 6, and a set of accelerating fuel increment tables, hereinafter referred to. The CPU 503 executes the control program read from the ROM 507 to calculate the fuel injection period TOUT for the fuel injection valves 6 in response to the various engine operation parameter signals and parameter signals for correction of the fuel injection period by means of the correction coefficients and correction variable, and supplies the calculated value of fuel injection period to the driving circuit 509 through the data bus 510. The driving circuit 509 supplies driving signals corresponding to the above calculated TOUT value to the fuel injection valves 6 to drive same.

Figures 4, 4A:
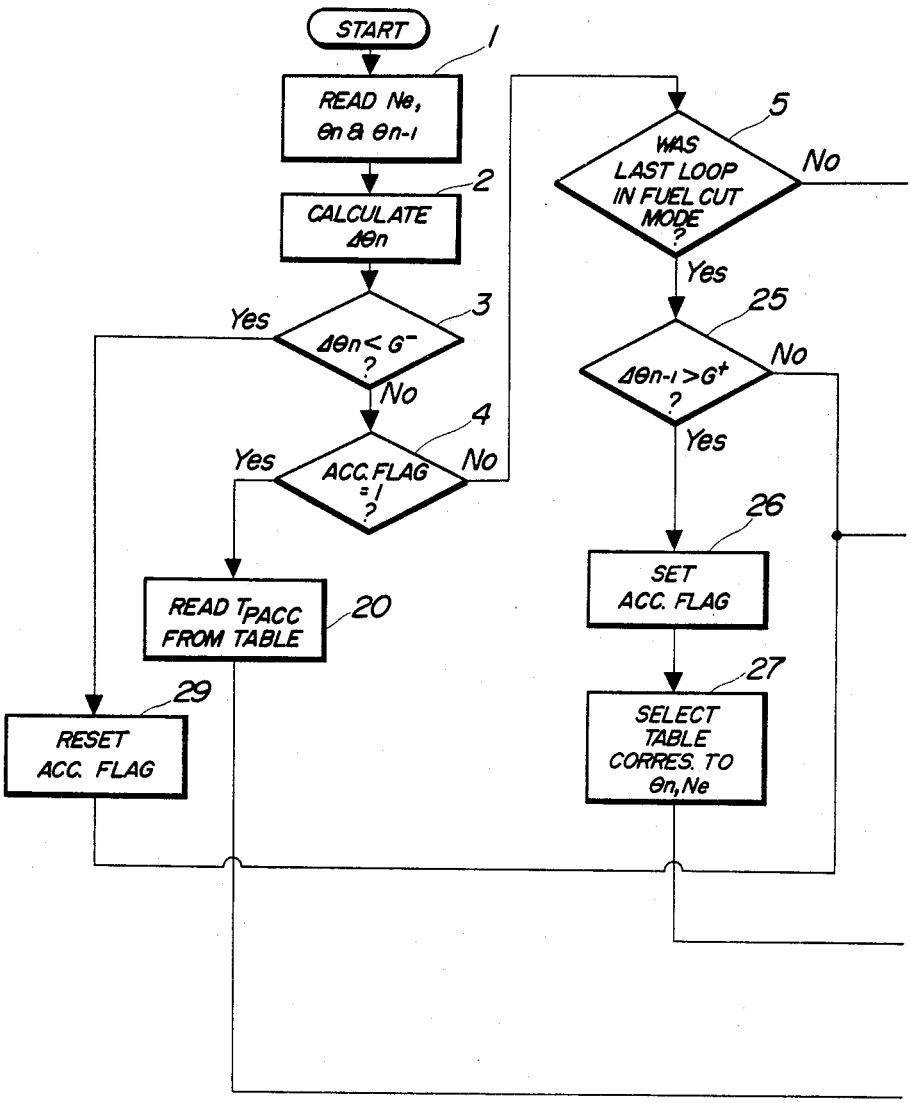
FIGS. 4, 4A and 4B constitute a flowchart of a subroutine for calculating the fuel injection quantity according to the method of the present invention.
Figure 4B:
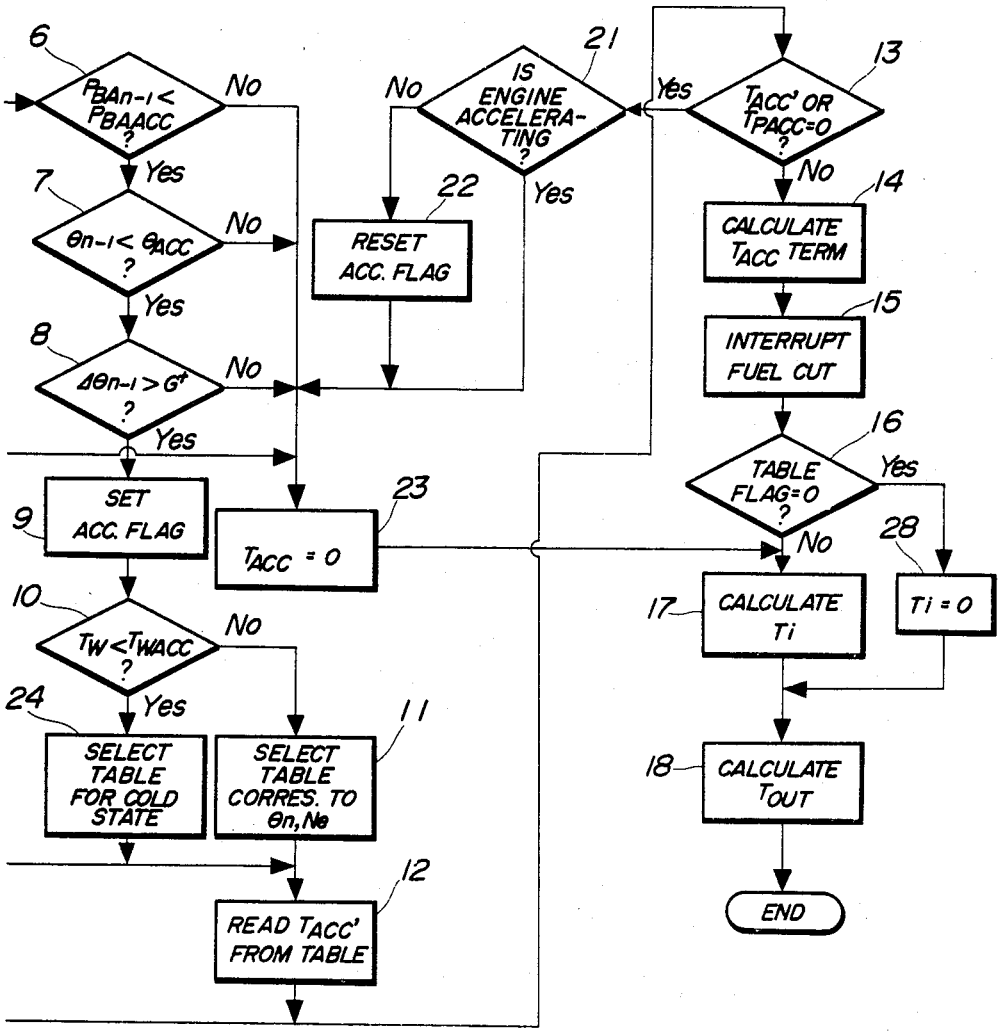

FIG. 4 is a flowchart of a subroutine for calculating the fuel injection quantity according to the method of the invention. First, values of the engine rotational speed Ne and the throttle valve opening $\theta n$ are read in synchronism with generation of each pulse of the TDC signal, and at the same time a value of the throttle valve opening $\eta n-1$ read and stored at the time of generation of the preceeding pulse of the TDC signal is read from the RAM 508 in FIG. 3, at the step 1. Then is obtained the difference $\Delta\theta n$ between these two values $\theta n$ and $\theta n-1$, at the step 2. It is then determined at the step 3 whether or not the difference $\Delta\theta n$ is smaller than a predetermined negative value $G^-$ for determination of fulfillment of a condition for deceleration control synchronous with the TDC signal. If the answer is negative, it is determined at the step 4 whether or not an acceleration flag has been set. This acceleration flag indicates whether or not the driver wants to accelerate the engine, and is set to a value of 1 when a predetermined accelerating condition is fulfilled, while it is reset to a value of 0 when a predetermined decelerating condition is fulfilled, or when required increase of the fuel supply quantity for acceleration of the engine has been completed.

If the answer to the question at the step 4 is no, the program proceeds to the step 5 to determine whether or not the engine was in a fuel-cut effecting condition in the last loop. If the answer to the question at the step 5 is negative, it is then determined at the step 6 whether or not an intake pipe absolute pressure value PBAn−1 detected in the last loop is lower than a predetermined upper limit PBAACC below which increase of the fuel supply quantity for acceleration of the engine should be effected. If the answer to the question at the step 6 is affirmative, it is determined at the step 7 whether or not a throttle valve opening value $\theta n-1$ detected in the last loop is smaller than a predetermined upper limit $\theta$ACC below which increase of the fuel supply quantity for acceleration of the engine should be effected.

If the answer to the question at the step 7 is affirmative, that is, if it is determined from the results of determinations at the steps 6, 7 that the engine is was not in a predetermined high load condition immediately before the present loop, the program proceeds to the step 8 to determine whether or not the engine is in the predetermined accelerating condition, more specifically, to determine whether or not the difference $\Delta\theta n-1$ between a value of the throttle valve opening $\theta n-1$ in the last loop and a value of same $\theta n-2$ in the loop immediately preceding the last loop is larger than a predetermined value $G^+$ for determination of fulfillment of the predetermined condition for acceleration control synchronous with the TDC signal. If the answer to the question at the step 8 is affirmative, one of a plurality of acceleration fuel increment tables is selected, which corresponds to the detected values of the throttle valve opening $\theta n$ and the engine rotational speed Ne, at step 11 or 24. If the answer to the question at step 8 is negative, the program proceeds to step 23, hereinafter described in detail, where the value of the correction variable TACC for increasing the fuel quantity for acceleration of the engine is set to zero. According to the method of the present invention in which the throttle valve opening is detected in synchronism with generation of pulses of the TDC signal, at acceleration of the engine with the throttle valve opening rapidly increased, the actual or detected throttle valve opening value can assume different values depending upon the time interval between the time point of starting of the opening action of the throttle valve through stepping-on of the accelerator pedal by the driver and the time point of generation of a pulse of the TDC signal at which the throttle valve opening is detected, even if the acceleration rate remains the same. As a consequence of this, according to the method of the invention wherein accelerating fuel increment tables are selected in response to detected values of the throttle valve opening $\theta$th and the engine rotational speed Ne as hereinafter described, such selection of the accelerating fuel increment tables cannot always be performed in a proper manner. Particularly, the smaller value the detected throttle valve opening value assumes, the greater the influence of the time point of starting of the opening action of the throttle valve upon the detected value of the throttle valve opening, and accordingly the more the possibility that improper fuel increment tables are selected.

Therefore, according to the present embodiment, the table selection is made upon generation of a pulse of the TDC signal immediately following a first pulse of the same signal at which the accelerating condition of the engine has been detected for the first time, since the possibility of selection of an improper accelerating fuel increment table is smaller at the time of generation of the immediately following pulse of the TDC signal. A value of the throttle valve opening $\theta$th detected at the time of generation of the immediately following TDC signal pulse is larger than one detected at the time of generation of the first TDC signal pulse so long as the same accelerating condition continues to exist. Therefore, the table selection at the time of generation of the immediately following TDC signal pulse can minimize the influence of the time point of starting of the valve opening action upon the accuracy of the detected valve opening value θth, thereby making it possible to properly select acceleration fuel increment tables. To this end, the determination at the step 8 of FIG. 4 is made as to whether or not a pulse of the TDC signal immediately preceding a present pulse of the same signal is the first pulse at which an accelerating condition of the engine has been detected for the first time.

If the answer to the question at the step 8 is yes, the acceleration flag is set to 1 at the step 9, followed by determining whether or not the detected engine cooling water temperature TW is lower than a predetermined value TWACC, at the step 10.

Figure 5:
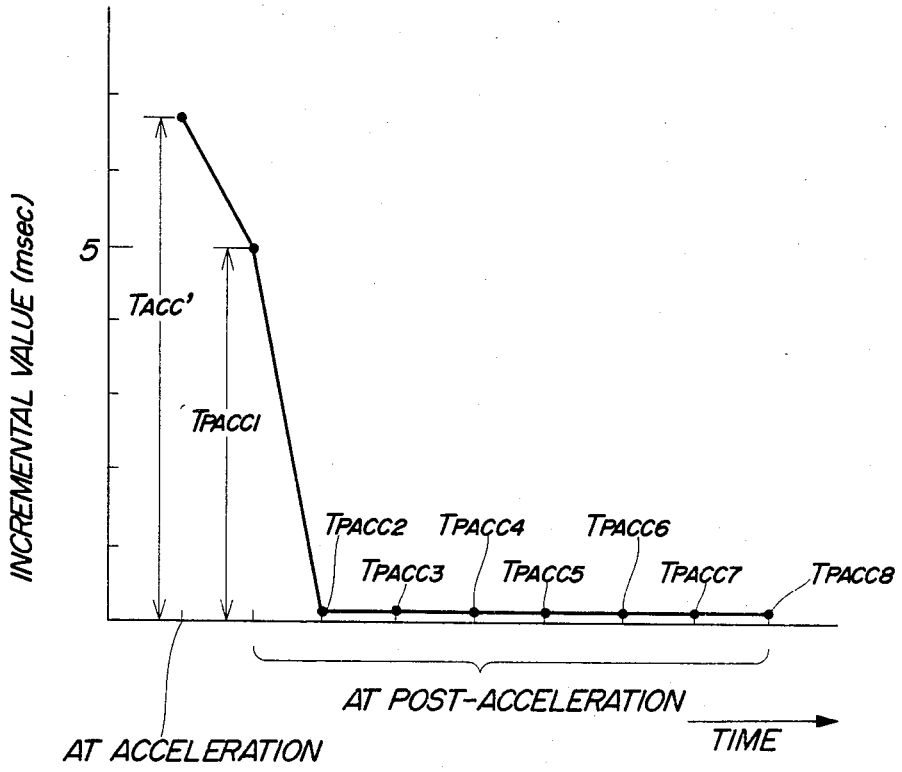
FIG. 5 is a graph showing one of accelerating fuel increment tables employed by the method of the present invention.

If the answer to the question at the step 10 is negative, that is, if the engine is not in a cold state, the step 11 is then executed to select a table corresponding to values of the throttle valve opening θn and the engine rotational speed Ne read in the step 1. If as in the example of FIG. 1, a single table of correction variable TACC is used for increasing the fuel supply quantity for the engine at acceleration, sudden displacement can take place in the position of the engine body on its mount as previously stated with reference to FIG. 1. To eliminate this disadvantage, according to the present invention, the whole operating region of the engine is divided into a plurality of operating regions dependent upon the throttle valve opening θn and the engine rotational speed Ne, and as many tables are provided, each of which is formed of a group of predetermined correction values which provide the engine with required fuel quantities in conformity with changes in the operating condition of the engine subsequent to the initial determination of the predetermined accelerating condition, that is estimated from values of the two parameters θn, Ne detected just at the start of acceleration of the engine, so as to minimize sudden displacement of the engine body on its mount at acceleration of the engine. To be specific, as shown in FIG. 5 by way of example, each of the tables has a group of predetermined correction values TACC' and TPACC which are successively applied with passage of time and set so as to increase the fuel supply quantity so as to follow an operating characteristic curve required by the engine at acceleration as they are successively applied with passage of time, which characteristic curve is estimated from respective detected values of the two parameters θn, Ne obtained just at the start of acceleration of the engine. In other words, each of the predetermined correction values TACC', TPACC in each table is set to provide a required fuel increment appropriate to the operating condition of the engine just at the moment it is applied.

An example of setting of such tables is shown in the Table.

In the above table, tables #1–#18 are provided which correspond, respectively, to eighteen divided operating regions dependent upon the two parameters θn, Ne, and previously stored in the ROM 507 in FIG. 3. According to this table setting, there are provided predetermined values Ne0–Ne4 of the engine rotational speed Ne, which are set, respectively, at 850 rpm, 1000 rpm, 1250 rpm, 1500 rpm, and 1700 rpm, and predetermined values θ0, θ1, and θ2 of the throttle valve opening θn, which are set, respectively, at 3°, 30°, and 80°.

TABLE

| | n | | |
|---|---|---|---|
| Ne | 0 < n ≦ 1 | 1 < n ≦ 2 | n > 2 |
| Ne < Ne0 | table #1 | table #7 | table #13 |
| Ne0 ≦ Ne<Ne1 | #2 | #8 | #14 |
| Ne1 ≦ Ne<Ne2 | #3 | #9 | #15 |
| Ne2 ≦ Ne<Ne3 | #4 | #10 | #16 |
| Ne3 ≦ Ne<Ne4 | #5 | #11 | #17 |
| Ne ≧ Ne4 | #6 | #12 | #18 |

Each of the tables #1–#18 is formed of a group of a predetermined correction value TACC consiting of an acceleration increment TACC' and post-acceleration increments TPACCi (i=1, 2, . . . 8), and also of a table flag value of 1 indicating that the last loop was not in fuel-cut mode. With this setting, if the detected values θn and Ne are 20° and 800 rpm, respectively, in the present loop, the first table #1, which is the table shown in FIG. 5, is selected to effect increase of the fuel supply quantity by the use of its acceleration and post-acceleration increments TACC', TPACCi. In the first table #1 are provided predetermined correction values TACC' and TPACC1–TPACC8, as well as a table flag value of 1.

Following the table selection at the step 11 in FIG. 4, the step 12 is executed, wherein a first predetermined correction value or accelerating fuel increment TACC' is read from the selected table, followed by a determination as to whether or not the read predetermined correction value TACC' is equal to 0, at the step 13. In the answer is no, the correction value TACC' is multiplied by the aforementioned coefficient K2 to determine the value of the second term in the equation (1), at the step 14, and the step 15 is executed to interrupt the fuel cut. In the following step 16 is made a determination as to whether or not the table flag has a value of 0. Since the flag value provided in each table is 1 as previously noted, the answer to the question at the step 16 is naturally negative. Following the step 16 are made of a calculation of the basic fuel injection period Ti from detected values of the intake pipe absolute pressure PBA and the engine rotational speed Ne, at the step 17, and a calculation of the fuel injection period TOUT for the fuel injection valves 6, based upon the calculated values of the second term and the basic fuel injection period Ti, at the step 18, thereby terminating execution of the present loop of the subroutine.

After entry of the next loop of the present subroutine upon generation of the next pulse of the TDC signal, due to setting of the acceleration flag to 1 at the step 9 because of the engine being then already in the predetermined accelerating condition, the program proceeds through the steps 1–4 and reaches the step 20. In the step 20, a correction value or post-acceleration fuel increment TPACC1 is read from the selected table, followed by a determination as to whether or not the same correction value is equal to 0, at the step 13. If the answer to this question is no, the aforementioned steps 14–18 are executed with the correction value TPACC1 applied, thereby terminating execution of the next or present loop of the subroutine. Thereafter, in each subsequent loop, if it is determined at the step 13 that a correction value TPACCi (i=2, 3, . . . 8) read from the table selected in the step 11 is equal to 0, e.g. the correction value TPACC2 in the first table #1, the program proceeds to the step 21 wherein it is determined whether or not the engine is still in the accelerating condition, on the basis of the aforementioned difference $\Delta\theta n$. If the answer to the question at the step 21 is negative, the acceleration flag is reset to 0 at the step 22, while if the answer is affirmative, the program skips to the step 23 to set the correction variable TACC of the equation (1) to 0, followed by execution of the steps 17 and 18, thereby terminating execution of the present loop of the subroutine. By virtue of the above described control, the fuel injection quantity and accordingly displacement of the engine at acceleration can be controlled to appropriate required values with accuracy as long as the engine requires increase of the fuel injection quantity, thereby effectively mitigating shock to be caused by acceleration of the engine and also improving the accelerability of the engine.

If the answer to the question at the step 10 is affirmative, that is, if the engine is determined to be in a cold state, a nineteenth table for cold operation of the engine, not shown, is selected at the step 24, in which are provided predetermined correction values TACC' and TPACC1–TPACC8 set so as to conform to accelerating requirement of the engine in a cold state and prevent sudden displacement of the engine body. After selection of the nineteenth table, the program proceeds to the step 12 wherefrom is executed the subroutine in the aforementioned manner.

If the answer to the question at the step 5 is affirmative, that is, if the last loop was in the fuel-cut mode, a determination is made in the step 25 as to whether or not the engine is in the predetermined accelerating condition, more specifically, whether or not the throttle valve opening difference $\Delta\theta n$ is larger than the aforementioned predetermined value $G^+$. If the answer is affirmative, the acceleration flag is set to 1 at the step 26, and the step 27 is executed to select one of another set of tables #20–#37, not shown, which corresponds to the detected values of the throttle valve opening $\theta n$ and the engine rotational speed Ne. This set of tables #20–#37 correspond, respectively, to eighteen operating regions of the engine which are divided in the same manner as the divided operating regions #1–#18 shown in FIG. 5, i.e. depending upon the throttle valve opening and the engine rotational speed. The aforementioned step 12 follows the step 27.

Each of the tables #20–#37 is formed of predetermined correction values TACC' and TPACC1–TPACC8, each different one of which is read out with generation of each pulse of the TDC signal so as to provide a gradually decreasing correction value, and of these tables, some selected when the engine is operating in a low speed region is also formed of a table flag value of 0 indicating that the last loop was in the fuel cut mode. Therefore, if the program proceeds through the steps 12–15 after execution of the step 27 and reaches the step 16, the answer to the question at the step 16 will be affirmative, and then the value of the basic fuel injection period Ti is set to 0, at the step 28. This is because the second term of the aforementioned equation (1) or correction variable TACC should assume a much larger value than the first term or basic fuel injection period Ti such that the use of the correction variable alone suffices for acceleration of the engine in an accelerating condition immediately after a fuel-cut effecting operation, and also because while the correction variable TACC assumes a value just appropriate to accelerating requirement of the engine, the basic fuel injection period does not always assume a properly required value particularly in the low speed region of the engine, since it is determined by the intake pipe absolute pressure PBA whose detected value can vary depending upon the timing relationship between the starting of the opening action of the throttle valve and the detection of the absolute pressure PBA. Therefore, according to the invention, the correction variable read from tables applied in the engine low speed region has its value set to a relatively large value containing an equivalent of the basic fuel injection period Ti, while the Ti value is set to zero at the step 28 as noted above. After the Ti value is thus set to 0, the steps 18 and 19 are executed, followed by terminating execution of the present loop of the subroutine.

If the answer to the question at the step 3 is affirmative, that is, if the throttle valve opening difference $\Delta\theta n$ is smaller than the predetermined value $G^-$, that is, if the engine is operating in the predetermined decelerating condition, the program proceeds to the step 29 to reset the acceleration flag to 0, followed by execution of the step 23. Therefore, if the decelerating condition is detected while the accelerating increase of the fuel supply quantity is being effected, the same accelerating increase is interrupted upon detection of the decelerating condition. Also when the engine is determined to be operating in a condition other than the predetermined accelerating condition at the step 25, the program proceeds to the step 23. If any one of the steps 6–8 provides a negative answer, that is, if the engine is determined to be in a high load condition or if the engine is determined to be neither in the high load condition or in the predetermined accelerating condition, the program likewise moves to the step 23. At the step 23 is the correction variable TACC set to 0, followed by execution of the steps 17–19, thereby terminating execution of the present loop of the subroutine.

Figure 6:
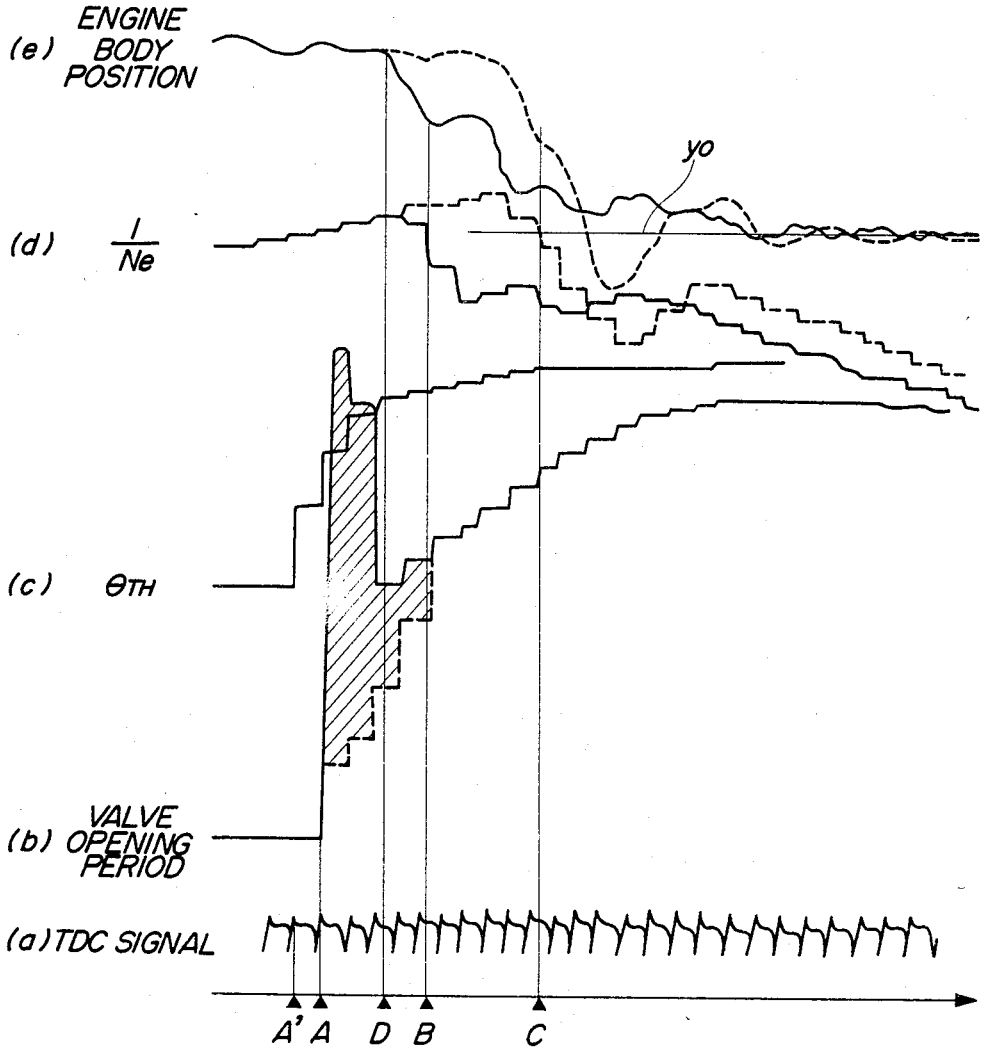
FIG. 6 is a timing chart showing changes in the engine rotational speed Ne, displacement of the engine body on its mount, etc. with the lapse of time at acceleration of the engine according to the method of the present invention.

FIG. 6 shows results of increase of the fuel supply quantity based upon the fuel injection period TOUT, showing operating characteristics of the engine, etc. according to the fuel supply control method of the invention. According to the example of FIG. 6, a valve opening action of the throttle valve is detected for the first time upon generation of a pulse of the TDC signal at the time point A' in (a) of FIG. 6. The rate of change $\Delta\theta n-1$ in the valve opening $\theta$th at this time is larger than the predetermined value $G^+$, that is, the engine is in the predetermined accelerating condition. But, it should be noted that no increase of the valve opening period TOUT with addition of the term TACC is then effected [at the time point A' in (b) of FIG. 6], until the time point A is reached when fuel is supplied with a value of the valve opening period TOUT which is corrected by the term TACC upon generation of the pulse of the TDC signal at the time point A immediately following the pulse of the same signal at the time point A'. The value of the term TACC is a value read from an acceleration fuel increasing correction variable table selected in response to values of the throttle valve opening $\theta n$ and the engine rotational speed Ne detected at the time point A. That is, the TACC value is set so as to optimize accelerating operation of the engine subsequent to the time point A, which is presumed at the time point A.

By virtue of this manner of control, it is possible to obtain an increase in the engine torque promptly after initiation of an accelerating operation, to accordingly enable starting an increase in the engine rotational speed Ne, i.e. a decrease in the value of 1/Ne shown in (d) of FIG. 6 before the lapse of a short period of time corresponding to the time period required for generation of four pulses of the TDC signal between the points A and B on the time abscissa in FIG. 6.

Further, since the value of the fuel increasing correction variable TACC is set to consecutive values appropriate, respectively, to operating conditions of the engine successively taking place with the progress of time, it is possible to control the amount of torque and the timing of increasing the torque by means of increases in the charging efficiency of the engine and the fuel supply quantity. Moreover, according to the invention, the accelerating fuel incremental value is set to values two to four times as large as a normal basic value ($Ti \times K1$) which is conventionally applied, at the time of initiation of acceleration just after the throttle valve has been opened when the charging efficiency is still small (five to ten times as large as the normal value immediately after termination of a fuel cut operation). This enables to attain an initial torque increasing period (the time period between the time points D and B in (e) of FIG. 6) soon after detection of acceleration of the engine (the point A' in FIG. 6). Further, the initial torque increase can be kept small due to the small charging efficiency at the time of initiation of acceleration of the engine, thereby minimizing the backlash of gears of the driving system without causing a shock, and at an early time shortly after detection of acceleration of the engine (the point B in FIG. 6) the engine body position can be brought to an intermediate position (in the vicinity of the point B in (e) of FIG. 6) in the course of its moving toward the stable position on the accelerating side (the level $y_o$ in (e) of FIG. 6). Such an amount of fuel is supplied to the engine as can maintain the mounting position of the engine body at the above intermediate position until the actual charging efficiency increases to obtain effective engine torque required for obtaining acceleration of the engine. As a result, rotational displacement of the engine body on its mount about the crankshaft can take place along a gentle curve as shown in (e) of FIG. 6, thereby reducing shock upon the driver which is caused by rotational displacement of the engine body on its mount about its crankshaft, as well as by backlash of the gears, etc. at acceleration of the engine.

According to the conventional example shown in (e) of FIG. 6, as indicated by the broken line therein, the engine body once collides with its mount at the point C, is then moved away from the mount by the colliding reaction force, and again moved back to its stable position (the level $y_o$ in (e) of FIG. 6), which delays the transmission of accelerating torque to the driving system. According to the present invention, as indicated by the solid line in (e) of FIG. 6, the engine body is already displaced to an intermediate position in the course of its displacement to its stable position upon acceleration of the engine and stably maintained thereat before the generation of effective torque, thereby obtaining accelerating torque at the same time of increase of the effective torque, resulting in improved accelerability of the engine.

What is claimed is:

1. A method of controlling the quantity of fuel being supplied to an internal combustion engine to values appropriate to operating conditions thereof in synchronism with generation of pulses of a predetermined control signal, the method comprising the steps of:

(a) setting beforehand a plurality of groups of predetermined correction values for increasing the quantity of fuel to be supplied to said engine at acceleration thereof, said predetermined correction values being functions of at least two operating parameters of said engine;

(b) determining whether or not said engine is operating in a predetermined accelerating condition;

(c) when it is determined for the first time that said engine is operating in said predetermined accelerating condition, detecting values of said at least two operating parameters upon the same determination being obtained;

(d) selecting one of said groups of predetermined correction values which corresponds to the detected values of said at least two operating parameters; and (e) successively applying different ones of said predetermined correction values of said selected one group for correction of the quantity of fuel being supplied to said engine, with passage of time after said determination that said engine is operating in said predetermined accelerating condition is obtained for the first time and as long as said engine is determined to be operating in said predetermined accelerating condition.

2. A method as claimed in claim 1, wherein each of said groups of said correction values is set so as to increase the quantity of fuel being supplied to said engine so as to follow a characteristic curve with passage of time, said characteristic curve being required by said engine operating in said predetermined accelerating condition when said at least two operating parameters assume values corresponding to said each of said groups of said predetermined correction values upon said determination being obtained for the first time that the engine is operating in said predetermined accelerating condition.

3. A method as claimed in claim 1, wherein in said step (c), values of said at least two operating parameters are detected, which are assumed instantaneously upon said determination being obtained for the first time that the engine is operating in said predetermined accelerating condition.

4. A method as clamed in claim 1, wherein said pulses of said predetermined control signal are generated at at least one particular crank angle of said engine.

5. A method as claimed in claim 4, wherein in said step (e), different ones of said predetermined correction values of said selected one group are successively read out in synchronism with pulses of said predetermined control signal generated immediately after said determination has been obtained for the first time that said engine is operating in said predetermined accelerating condition.

6. A method of controlling the quantity of fuel being supplied through injection to an internal combustion engine having an intake passage, and a throttle valve arranged therein, to values appropriate to operating conditions of said engine in synchronism with pulses of a predetermined control signal generated at at least one predetermined rotational angle position of said engine, the method comprising the steps of:

(a) setting beforehand a plurality of predetermined operating regions of said engine divided as a function of the valve opening of said throttle valve and the rotational speed of said engine;

(b) setting beforehand a plurality of tables corresponding, respectively, to said predetermined operating regions of said engine, each of said tables having set therein a plurality of predetermined correction values for increasing the quantity of fuel to be supplied to said engine at acceleration thereof;

(c) determining whether or not said engine is operating in a predetermined accelerating condition;

(d) when it is determined for the first time that said engine is operating in said predetermined accelerating condition, detecting values of the valve opening of said throttle valve and the rotational speed of said engine upon the same determination being obtained;

(e) selecting one of said tables which corresponds to one of said predetermined operating regions of said engine to which correspond the detected values of the valve opening of said throttle valve and the rotational speed of said engine; and (f) successively applying different ones of said predetermined correction values read from said selected one table for correction of the quantity of fuel being supplied through injection to said engine, with passage of time after said determination is obtained for the first time that said engine is operating in the predetermined accelerating condition and as long as said engine is operating in said predetermined accelerating condition.

7. A method as claimed in claim 6, wherein each of said tables is set so as to increase the quantity of fuel being supplied through injection to said engine so as to follow a characteristic curve with passage of time, said characteristic curve being required by said engine operating in said predetermined accelerating condition when the valve opening of said throttle valve and the rotational speed of said engine assume values corresponding to said each of said tables upon said determination being obtained for the first time that the engine is operating in said predetermined accelerating condition.

8. A method as claimed in claim 6, wherein in said step (f), different ones of said predetermined correction values of said selected one table are successively read out in synchronism with pulses of said predetermined control signal generated immediately after said determination has been obtained for the first time that said engine is operating in said predetermined accelerating condition.

9. A method as claimed in claim 6, including the steps of setting beforehand at least one second table having set therein a plurality of correction values for increasing the quantity of fuel to be supplied to said engine at acceleration thereof, determining whether or not said engine is operating in a particular operating condition when it is determined in said step (c) that said engine is operating in said predetermined accelerating condition, and selecting in said step (e) one of said at least one second table which corresponds to said predetermined operating condition when it is determined that said engine is operating in said particular operating condition, in place of said first-mentioned tables.

10. A method as claimed in claim 9, wherein said particular operating condition is fulfilled when said engine is operating immediately after termination of a fuel cut operation of said engine at deceleration.

11. A method as claimed in claim 9, wherein said particular operating condition is fulfilled when said engine is operating in a cold state.

12. A method as claimed in claim 10, including the steps of calculating a basic value of a quantity of fuel being supplied to said engine, in response to at least one operating parameter of said engine, and setting and holding said basic value to and at zero while said correction of the quantity of fuel being supplied to said engine is effected by the use of said correction values is effected in said step (f), when it is determined that said engine is operating in said particular operating condition immediately after termination of said fuel cut operation of said engine at deceleration.

13. A method as claimed in claim 10, wherein when it is determined that said engine is operating in said particular operating condition immediately after termination of said fuel cut operation of said engine at deceleration, the correction values of said selected one of said at least one second table are read out in a manner providing a gradually decreasing correction value each time a pulse of said predetermined control signal is generated immediately after said determination has been obtained for the first time that said engine is operating in said predetermined accelerating condition.

14. A method as claimed in claim 7, including the steps of detecting whether or not said engine is operating in a predetermined decelerating condition while said correction of the quantity of fuel being supplied to said engine is effected by the use of said correction values in said step (f), and interrupting said correction upon determination that said engine is operating in said predetermined decelerating condition.

15. A method as claimed in claim 6, wherein said engine has a plurality of cylinders and a plurality of fuel injection valves provided for respective ones of said cylinders, said method being adapted to control the quantity of fuel being sequentially injected into different ones of said cylinders through said fuel injection vales.

* * * * *